US005844454A

United States Patent [19]

Ono et al.

[11] Patent Number: 5,844,454

[45] Date of Patent: Dec. 1, 1998

[54] DIELECTRIC FILTER WITH NON-CONDUCTIVE EDGE

[75] Inventors: Shoji Ono; Masaki Shibata, both of Nagoya, Japan

[73] Assignee: NGK Spark Plug Co., Ltd., Japan

[21] Appl. No.: 823,206

[22] Filed: Mar. 24, 1997

[30] Foreign Application Priority Data

Mar. 29, 1996 [JP] Japan ..... 8-076207

[51] Int. Cl.[6] ..... H01P 1/205

[52] U.S. Cl. ..... 333/206; 333/207

[58] Field of Search ..... 333/202, 206, 333/207, 222, 223

[56] References Cited

U.S. PATENT DOCUMENTS 4,464,640 8/1984 Nishikawa et al. ..... 333/202
5,642,084 6/1997 Matsumoto et al. ..... 333/206 X

FOREIGN PATENT DOCUMENTS 62-61504 4/1987 Japan .
3-89602 4/1991 Japan ..... 333/206
3-293802 12/1991 Japan ..... 333/202
8-8607 1/1996 Japan .
2 163 606 2/1986 United Kingdom .

OTHER PUBLICATIONS

Patent Abstracts of Japan; vol. 8, No. 49 (E–230), 6 Mar. 1984 & JP 58 204601 A (Murata Seisakusho KK), 29 Nov. 1983, * abstract *.

*Primary Examiner*—Seungsook Ham
*Attorney, Agent, or Firm*—Larson & Taylor

[57] ABSTRACT

A dielectric filter for a high frequency band includes a plurality of resonators formed by boring a plurality of through holes between the oppositely disposed end surfaces of a dielectric block in parallel with each other and arranging internal conductors on the inner peripheral surfaces of the respective through holes and an external conductor formed on a substantial portion of the outer peripheral surface of the dielectric block. A non-conductive region is formed on the short-circuit end surface and extends in parallel with the direction connecting the resonators, thereby the filter can be controlled satisfactorily for coupling the dielectric coaxial resonators and have a reduced height.

8 Claims, 11 Drawing Sheets

W=3.0

W=2.5

W=2.0

W=1.0

DIELECTRIC FILTER WITH NON-CONDUCTIVE EDGE

BACKGROUND OF THE INVENTION

1. Field of the Invention

The present invention relates to a dielectric filter comprising a plurality of dielectric coaxial resonators arranged in parallel with each other.

2. Prior Art

There have been known various dielectric filters realized by boring a plurality of through holes through a dielectric block in parallel with each other between a pair of oppositely disposed end surfaces of a dielectric block, providing internal conductors on the inner peripheral surfaces of the respective through holes to form a plurality of dielectric coaxial resonators, providing an external conductor on a substantial portion of the outer peripheral surface of the dielectric block and providing a short-circuit conductor on one of the end surfaces of the dielectric block to make it a short-circuit end surface for connecting the external conductor on the outer peripheral surface and the internal conductors on the inner peripheral surfaces of the through holes. A dielectric filter having such a configuration is typically used as filters for high frequency bands.

FIG. 1 of the accompanying drawings illustrates such a conventional dielectric filter comprising a dielectric block A which is provided with two resonators B and has one end surface or a short-circuit end surface C provided with a region D having no short-circuit conductor between the resonators B as interstage coupling means of the resonators of the dielectric filter (Refer to Japanese Patent Kokai No. 3-293802).

The applicant of the present application proposed in Japanese Patent Application No. 6-163189 (Japanese Patent Kokai No. 8-8607) a dielectric filter for a high frequency band as shown in FIG. 2 realized by providing a dielectric block 1 with a pair of through holes 2*a* and 2*b* extending in parallel with each other therethrough, providing internal conductors 3*a* and 3*b* on the inner surfaces of the respective through holes 2*a* and 2*b* to produce a pair of dielectric coaxial resonators, providing an external conductor 4 on a given area of the outer peripheral surface and providing a short-circuit conductor on one of the end surfaces of the dielectric block 1 to make it a short-circuit conductor end surface 5 for connecting the external conductor 4 and the internal conductor 3*a* and 3*b*, the other end surface being left as open-circuit end surface 6, wherein a slot 7 is formed by removing the external conductor 4 along a direction perpendicular to the through holes 2*a* and 2*b* in an area of the outer peripheral surface located close to the short-circuit conductor end surface 5 in order to couple and polarize the dielectric coaxial resonators at a same time in a simple manner.

With a conventional dielectric filter for a high frequency band provided with a slot devoid of a short-circuit conductor formed along a direction perpendicular to and between the dielectric coaxial resonators on the short-circuit conductor end surface in order to couple resonators as described above by referring to FIG. 1, the slot is required to have a considerable width and hence a large surface area that occupies about ⅔ of the total area of the short-circuit end surface to ensure a sufficient coupling effect at the cost of a reduced Q value.

Additionally, the slot formed on the short-circuit end surface along a direction perpendicular to and between the resonators can reduce the mechanical strength of the dielectric filter (Refer to Japanese UM Kokai No. 62-61504).

With such a dielectric filter illustrated in FIG. 2 a shield case is applied thereto typically after directly connecting input/output terminals formed on the lower portion of the outer peripheral surface located opposite to the side of the coupling slot is connected directly with a printed circuit board. The inner wall of the shield case has to be separated from the coupling slot on the top side of the outer peripheral surface by at least 3 mm because the coupling effect of the slot changes significantly when the inner wall of the shield case comes too close to or into contact with the coupling slot on the top side of the outer peripheral surface. This involves a problem that a dielectric filter for a high frequency band cannot reduce its height beyond a certain degree.

Therefore, it is an object of the present invention to provide a dielectric filter with a reduced height that can solve the above problem without damaging the coupling effect and reducing the Q value.

SUMMARY OF THE INVENTION

According to the invention, the above object is achieved by providing a dielectric filter in which a plurality of through holes are provided to be extended between oppositely disposed end surfaces of a dielectric block in parallel with each other, each through hole has an inner peripheral surface provided with an internal conductor for forming a plurality of resonators, an external conductor is provided on a substantial portion of the outer peripheral surface of the dielectric block, one of the end surfaces is a short-circuit end surface provided with a short-circuiting conductor for connecting the external conductor on the outer peripheral surface and the internal conductors on the inner peripheral surfaces of the through holes, and the other end surface is an open-circuit end surface, wherein at least one region devoid of short-circuiting conductor is formed on the short-circuit end surface and extends in parallel with the direction connecting the resonators.

The region devoid of short-circuiting conductor formed on the short-circuit end surface of the dielectric block may extend along at least an edge of the short-circuit end surface.

The region devoid of short-circuiting conductor formed-on the short-circuit end surface may comprise a slot extending along at least an edge of the short-circuit end surface.

The region devoid of short-circuiting conductor extending along the direction connecting the resonators may have a width selected between a value equal to the distance separating the axes of any two adjacently located resonators and a value smaller than the width of the block.

With a dielectric filter for a high frequency band having a configuration as described above, the dielectric coaxial resonators formed in the respective through holes are coupled for electric field at the open-circuit end surface and for magnetic field at the short-circuit end surface. Therefore, the magnetic coupling of the resonators are intensified because the magnetic field is made less apt to swerve to the external conductor side by the region devoid of short-circuit conductor formed along an edge of the short-circuit end surface running in parallel with the direction connecting the resonators. Thus, they are coupled more intensely for magnetic field than for electric field so that any adjacently located resonators are coupled intensely for magnetic field to give rise to an interstage coupling.

Such a region devoid of short-circuiting conductor may advantageously be formed by producing a transversal slit on an end surface of the dielectric block typically by means of a dicing saw and removing the short-circuit conductor in that region. The slit may be formed in the operation of producing a dielectric block by press machining. If such is the case, the short-circuit conductor surface is produced by applying a conductive material onto that surface except the slit.

Alternatively, the region devoid of short-circuiting conductor may be produced by applying a conductive material to the entire surface and thereafter partly removing it to form a slit by means of a laser trimmer or sand blast.

Still alternatively, the non-conductive region may be formed by screen printing or patterning at the timing of forming a film of a short-circuit conductor.

DESCRIPTION OF THE PREFERRED EMBODIMENT OF THE INVENTION

Figure 3:
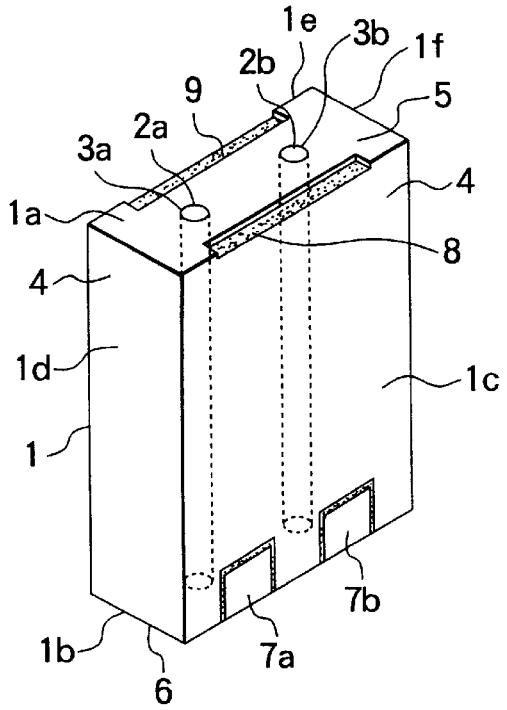
FIG. 3 is a schematic perspective view of an embodiment of two-stage type dielectric filter for a high frequency band according to the invention.

The present invention will now be described by referring to FIGS. 3 and 4 illustrating an embodiment of dielectric filter according to the invention.

In FIGS. 3 and 4, there is shown a two-stage type dielectric filter for a high frequency band comprising a pair of dielectric coaxial resonators formed in a single dielectric block 1.

Referring to FIGS. 3 and 4, the dielectric block 1 is a rectangular parallelpiped made of a ceramic dielectric material containing titanium and having an end surface 1*a*, another end surface 1*b* and four outer lateral side surfaces 1*c*, 1*d*, 1*e* and 1*f*. A pair of through holes 2*a* and 2*b* are bored through the dielectric block 1 in parallel with each other and extend between one end surface la and the other end surface 1*b*. Internal conductors 3*a* and 3*b* are formed respectively on the inner peripheral surfaces of the through holes 2*a* and 2*b* by applying a conductive material to produce a pair of dielectric coaxial resonators. An external conductor 4 is formed on the outer lateral side surfaces 1*c*, 1*d*, 1*e* and 1*f* and is used as a grounding conductor. A short-circuit conductor 5 is formed on the end surface la and electrically connected to the external conductor 4 on the outer lateral side surfaces 1*c*, 1*d*, 1*e* and 1*f*. In this way, the short-circuit conductor 5 electrically connects the internal conductors 3*a* and 3*b* of the dielectric coaxial resonators to the external conductor 4. Thus, the end surface 1*a* may well be referred to as short-circuit end surface. The other end surface 1*b* of the dielectric block 1 carries no conductor and therefore operates as an open-circuit end surface 6.

Input/output conductors 7*a* and 7*b* are formed on the outer lateral side surface 1*c* and electrically insulated from the external conductor 4. The input/output conductor 7*a* is capacitively connected to the internal conductor 3*a* via the dielectric block 1, whereas the input/output conductor 7*b* is capacitively connected to the internal conductor 3*b* also via the dielectric block 1. One of the input/output conductors 7*a* and 7*b* is connected to an input terminal of an electric circuit while the other input/output conductor is connected to an output terminal of the circuit to complete the electric connection of the dielectric filter for a high frequency band.

With the dielectric filter having a configuration as described above, according to the invention a pair of regions 8 and 9 devoid of short-circuit conductor or non-conductive regions are formed along the oppositely disposed respective edges of the short-circuit end surface 5, extending along the direction connecting the resonators as shown in FIGS. 3 and 4. The regions 8 and 9 devoid of short-circuit conductor may be formed by coating the end surface la with a short-circuit conductor and subsequently removing it to form the regions typically by means of a laser trimmer or sand blast.

Figure 4A:
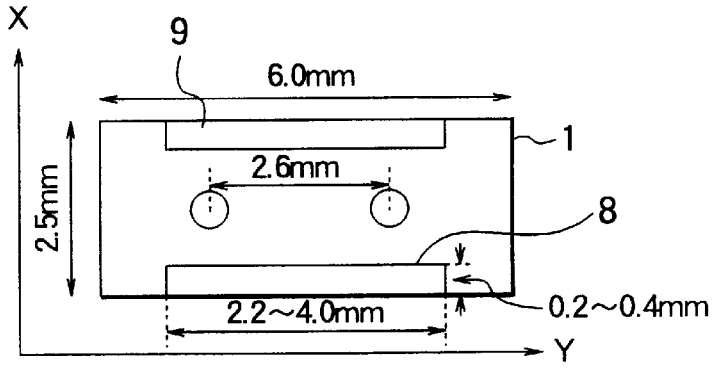
FIG. 4A is a schematic view of the embodiment of dielectric filter of FIG. 3, showing one of its end surfaces with dimensional values.
Figure 4B:
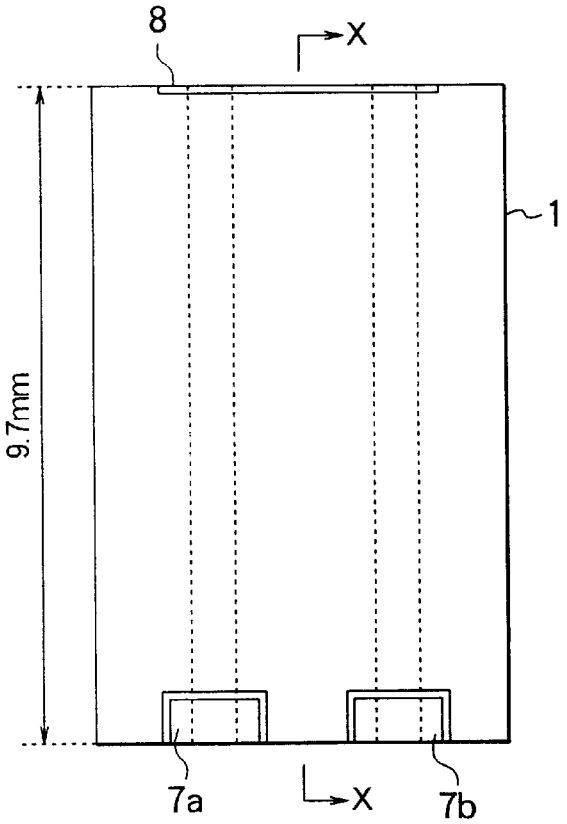
FIG. 4B is a schematic front view of the embodiment of dielectric filter of FIG. 3.
Figure 4C:
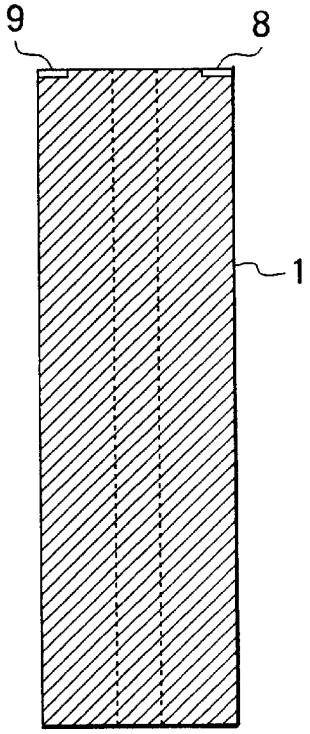
FIG. 4C is a schematic cross sectional view taken along line X—X in FIG. 4B.
Figure 6:
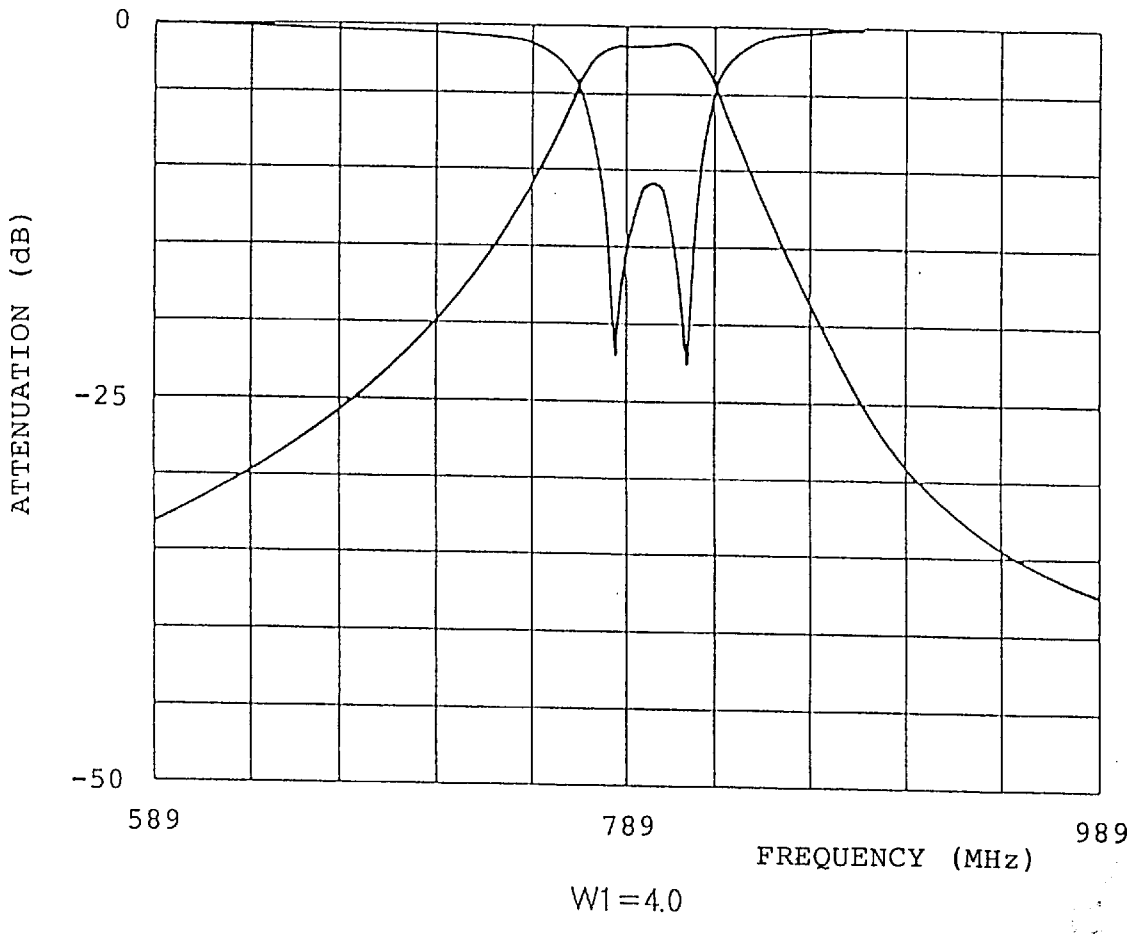
FIG. 6 is a graph showing the electric characteristic of a two-stage type dielectric filter for a high frequency band according to the invention.
Figure 7:
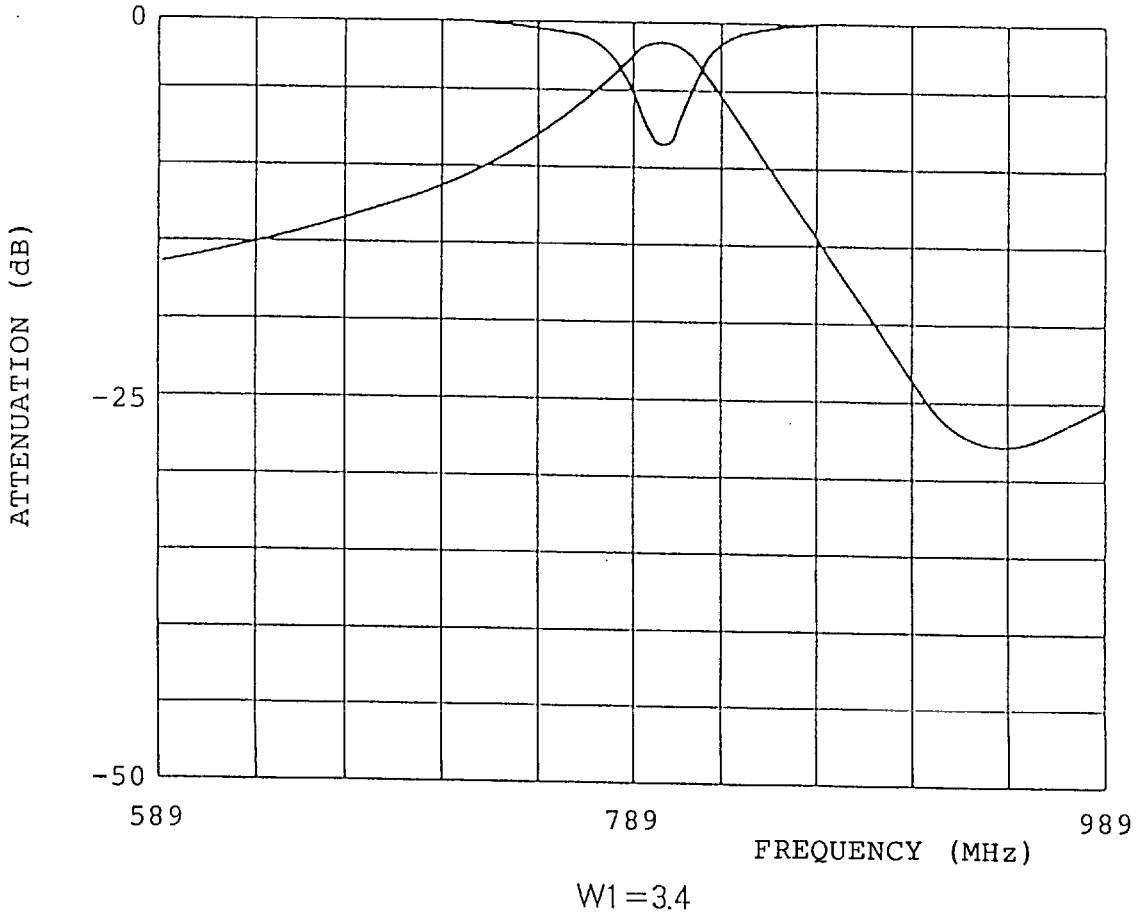
FIG. 7 is a graph showing the electric characteristic of a two-stage type dielectric filter with a region devoid of short-circuit conductor having dimensions different from those of FIG. 6.
Figure 8:
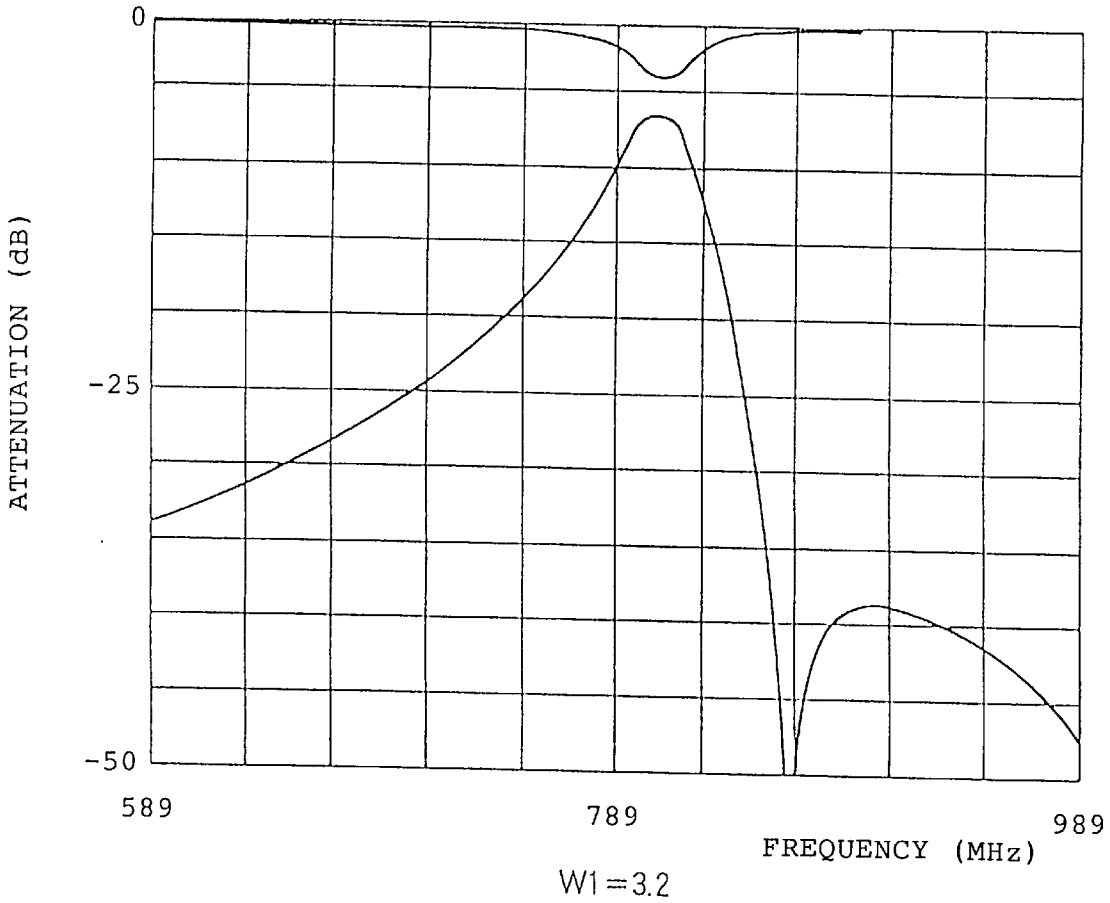
FIG. 8 is a graph showing the electric characteristic of a two-stage type dielectric filter with a region devoid of short-circuit conductor having dimensions different from those of FIGS. 6 or 7.
Figure 9:
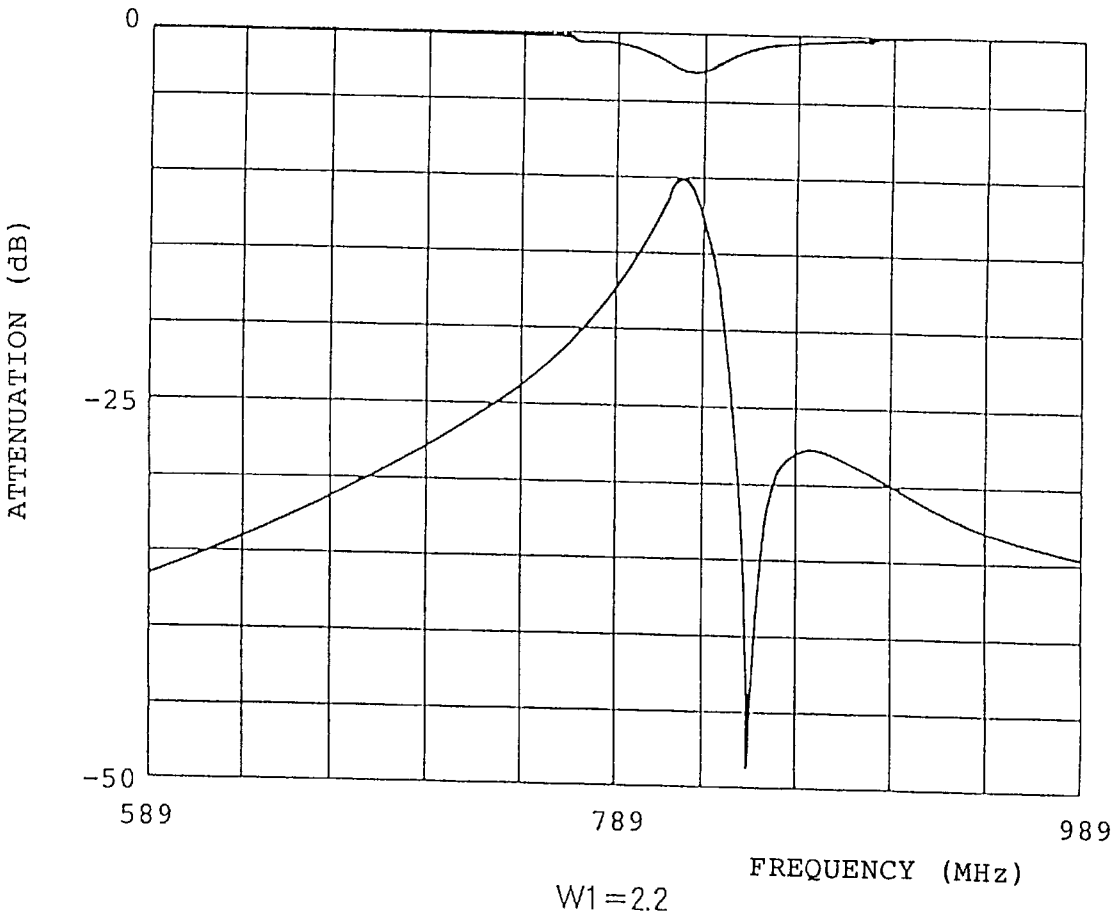
FIG. 9 is a graph showing the electric characteristic of a two-stage type dielectric filter with a region devoid of short-circuit conductor having dimensions different from those of FIGS. 6, 7 or 8.
Figure 10:
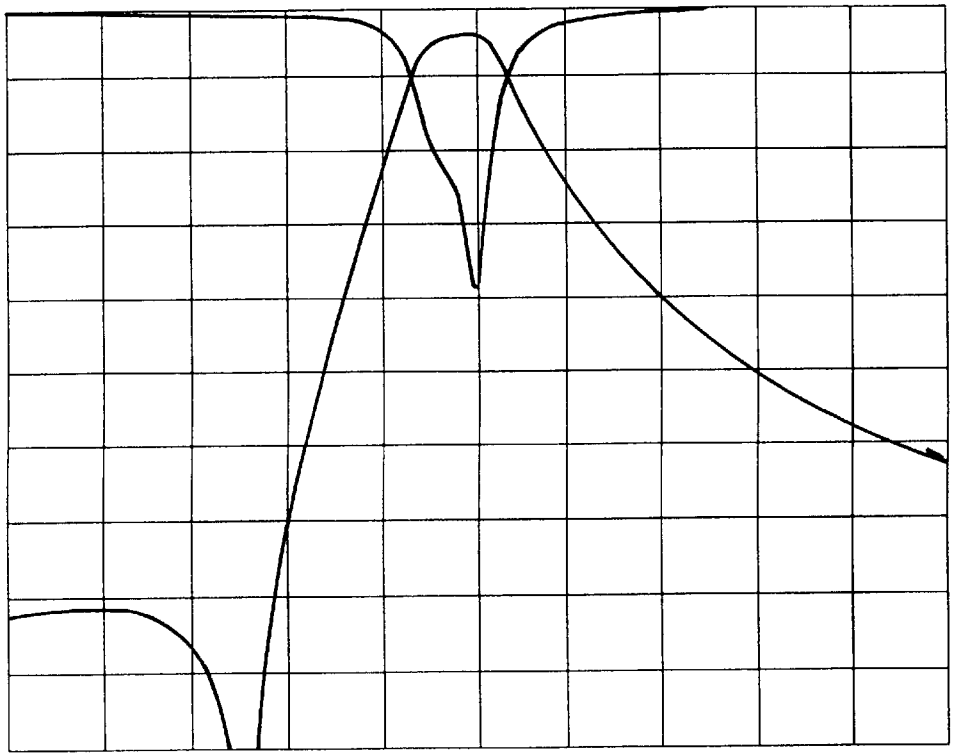
FIG. 10 PRIOR ART
FIG. 10 is a graph showing the electric characteristic of a comparable conventional dielectric filter as shown in FIG. 1.
Figure 11:
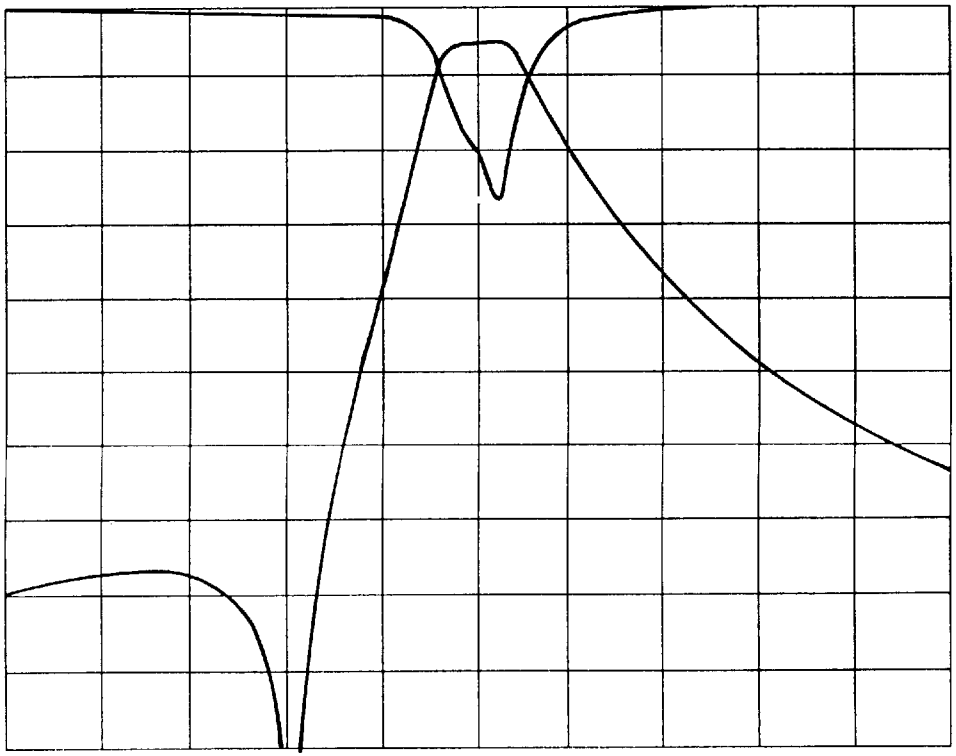
FIG. 11 PRIOR ART
FIG. 11 is a graph showing the electric characteristic of a comparable conventional dielectric filter with a region devoid of short-circuit conductor having dimensions different from those of FIG. 10.
Figure 12:
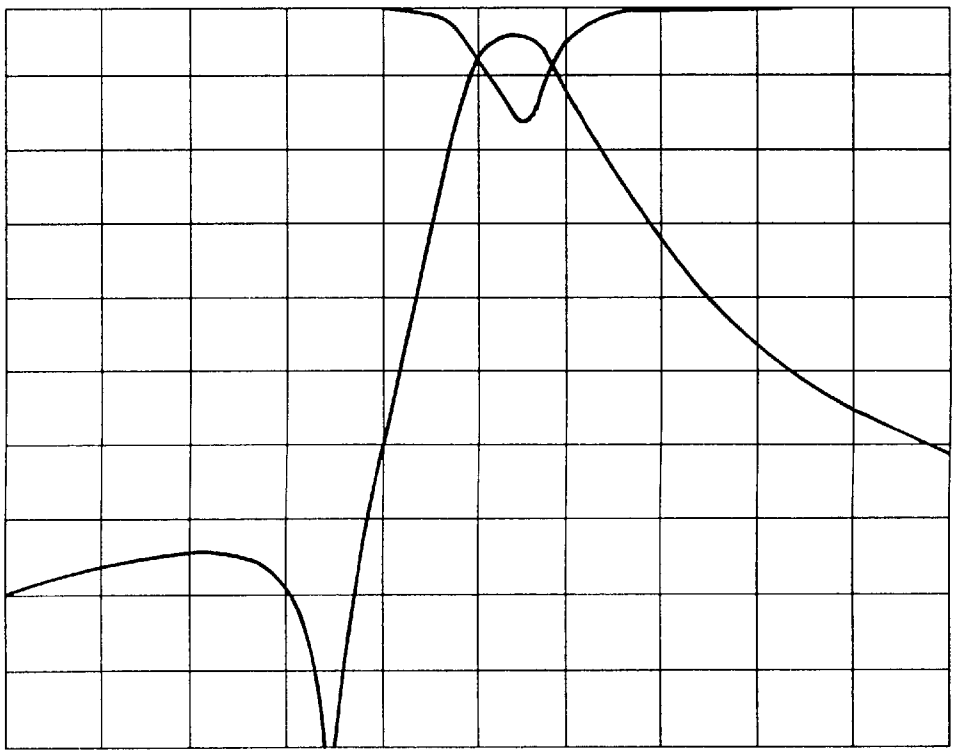
FIG. 12 PRIOR ART
FIG. 12 is a graph showing the electric performance of a comparable conventional dielectric filter with a region devoid of short-circuit conductor having dimensions different from those of FIGS. 10 or 11.
Figure 13:
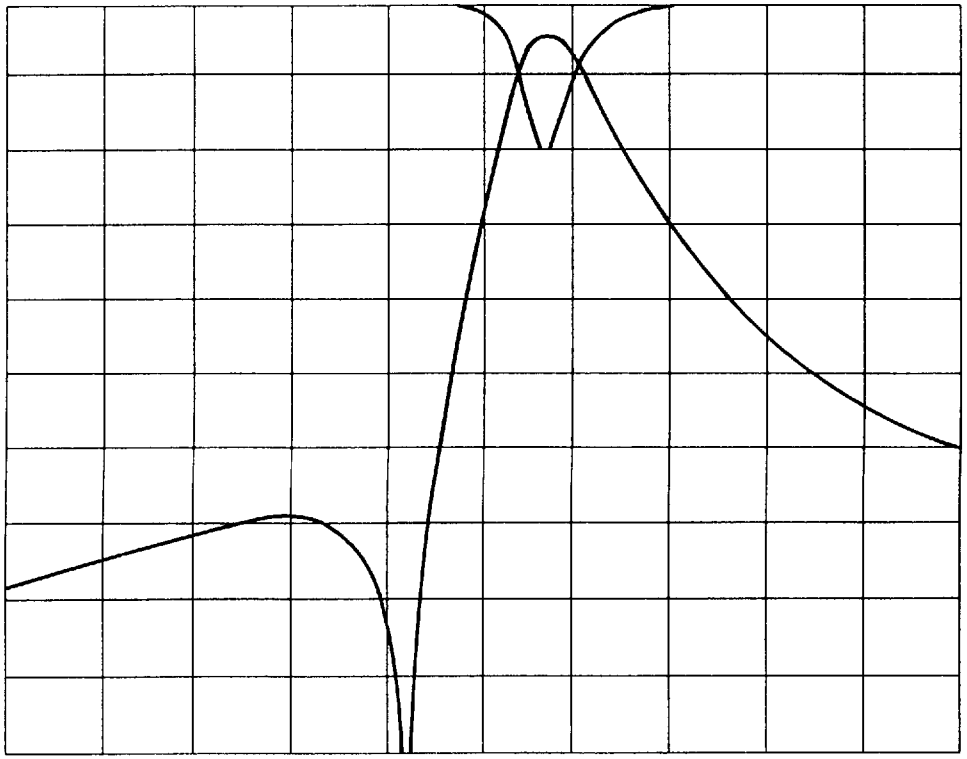
FIG. 13 PRIOR ART
FIG. 13 is a graph showing the electric performance of a comparable conventional dielectric filter with a region devoid of short-circuit conductor having dimensions different from those of FIGS. 10, 11 or 12.

Alternatively, the regions 8 and 9 devoid of short-circuit conductor may be formed by producing a pair of transversal shallow slits typically by means of a dicing saw and removing the short-circuit conductor in that regions as shown in FIGS. 4B and 4C. The slits may be formed in the operation of producing a dielectric block by press machining. If such is the case, the short-circuit conductor surface is produced by applying a conductive material onto that surface except the slits, which then becomes regions 8 and 9 devoid of short-circuit conductor.

Still alternatively, the non-conductive regions may be formed by screen printing or patterning at the timing of forming an external conductor and a film of a short-circuit conductor.

FIGS. 4A, 4B and 4C show dimensional values of the dielectric filter for a high frequency band thus constructed.

Figure 5:
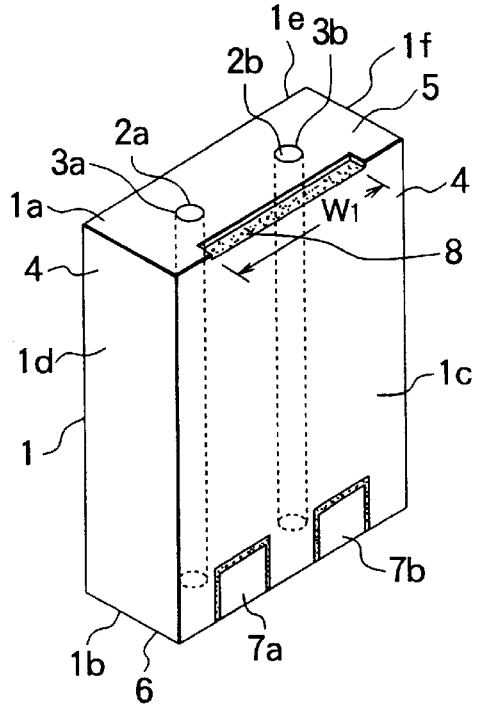
FIG. 5 is a schematic perspective view showing a modification of the embodiment of FIG.3.

FIG. 5 illustrates a modification of the embodiment of FIG.3, in which a single non-conductive region 8 is formed along one of the edges of the short-circuit end surface 5, extending along the direction connecting the resonators.

FIGS. 6 through 9 are graphs illustrating an electric characteristic of such a dielectric filter having such a configuration as shown in FIG. 5 observed when different values were used for the width W1 of the region 8.

Figure 1:
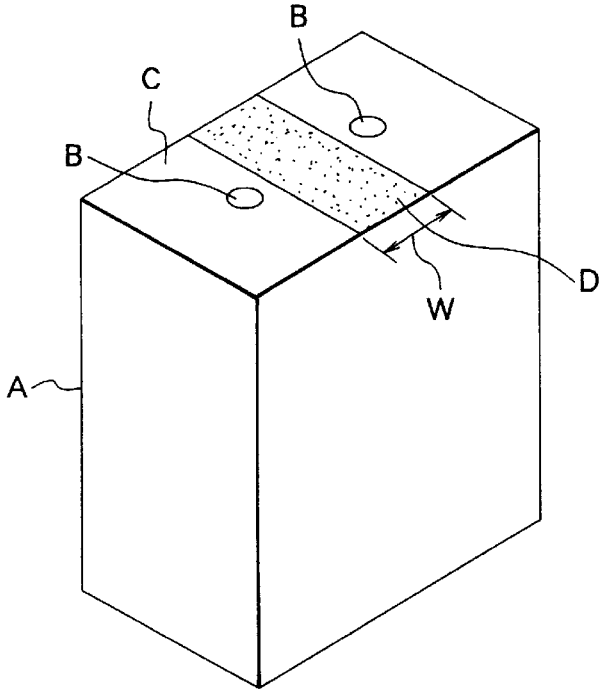
FIG. 1 PRIOR ART
FIG. 1 is a schematic perspective view of a comparable conventional dielectric filter.
Figure 2:
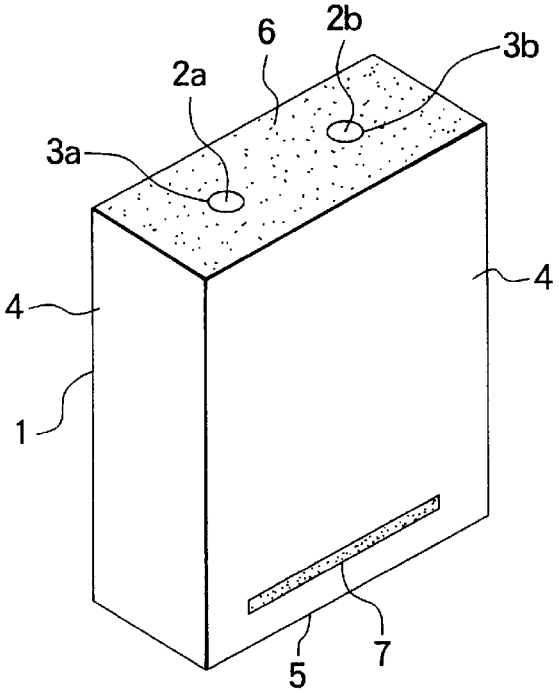
FIG. 2 PRIOR ART
FIG. 2 is a schematic perspective view of a conventional dielectric filter previously proposed by the inventors of the present invention.

For the purpose of comparison, FIGS. 10 through 13 show graphs illustrating the electric characteristic of the conventional dielectric filter as shown in FIG. 1 also observed when different values were used for the width W of the region D devoid of short-circuit conductor.

By comparing the graphs for the two dielectric filters, it will be seen that the region devoid of short-circuit conductor of the dielectric filter according to the invention has a relatively small area of about ⅓ of the short-circuit end surface and the dielectric filter shows a satisfactory coupling effect, whereas the comparable region of the conventional dielectric filter of FIG. 1 has to be made as large as about ⅔ of the short-circuit end surface to achieve a similar coupling effect. Thus, the conventional dielectric filter such as shown in FIG. 1 is accompanied by a problem of regulating difficulty and a reduced Q value.

The coupling effect became remarkable when the region devoid of short-circuit conductor is expanded along the X-direction rather than along the Y-direction as shown in FIG. 4A. This means that the dielectric filter of the present invention shows an excellent controllability if compared with the conventional dielectric filter of FIG. 1 where a region devoid of short-circuit conductor is formed between the resonators.

While the above embodiment is a two-stage type dielectric filter for a high frequency band comprising a pair of dielectric coaxial resonators, the present invention is applicable to a three-stage type dielectric filter comprising three dielectric coaxial resonators or a four- or higher stage type dielectric filter.

The performance of a dielectric filter according to the invention (in terms of frequency bandwidth, attenuation pole generating frequency, etc.) can be controlled by regulating the position and the surface area of the region devoid of short-circuit conductor. Therefore, the region devoid of short-circuit conductor may be modified transversally (in the Y-direction) and/or longitudinally (in the X-direction) to substantially change its location and/or area in order to regulate the performance of the dielectric filter after forming the region.

As described above, with the dielectric filter according to the invention since a region devoid of short-circuit conductor is formed on the short-circuit end surface along a direction connecting the through holes to realize an inter-stage coupling, no coupling groove, slit nor spot facing has to be formed after producing a dielectric block for the filter so that such a dielectric filter can be manufactured efficiently in a well controlled manner with a desired coupling performance without reducing the Q value and a reduced mechanical strength. Thus, the present invention provide a remarkable technological advantage for manufacturing a dielectric filter for a high frequency band that operates stably and reliably.

We claim:

1. A dielectric filter comprising:

a dielectric block having oppositely disposed rectangular end surfaces and an outer peripheral surface therebetween;

a plurality of resonators provided in the dielectric block in parallel with respect to each other, each of the resonators including a through hole provided to be extended between the oppositely disposed end surfaces of the dielectric block and an internal conductor provided on an inner peripheral surface of the respective through hole;

an external conductor provided on a substantial portion of the outer peripheral surface of the dielectric block, one of the end surfaces being a rectangular short-circuit end surface provided with a short-circuiting conductor for connecting the respective internal conductors of the resonators with the external conductor on the outer peripheral surface, and the other end surface being a rectangular open-circuit end surface;

a non-conductive region of short-circuiting conductor provided on the short-circuit end surface for intensifying a magnetic coupling of the respective resonators, said non-conductive region (a) extending longitudinal along a longer edge of the rectangular short-circuit end surface in parallel with a direction connecting the respective resonators, (b) beginning laterally at an intersection with an adjacent peripheral surface and (c) having a longitudinal width equal to or larger than a distance between the through holes of the outermost resonators.

2. A dielectric filter as claimed in claim 1, further comprising another non-conductive region of short-circuiting conductor formed on said short-circuit end surface and extending longitudinally along a respective longer edge of the rectangular short-circuit end surface and beginning laterally at an intersection with an adjacent peripheral surface.

3. A dielectric filter as claimed in claim 1, wherein said non-conductive region of short-circuiting conductor formed on said short-circuit end surface comprises a slot.

4. A dielectric filter as claimed in claim 3, wherein said slot is formed by screen printing or patterning at the time of forming of the external and short-circuiting conductors on said dielectric block.

5. A dielectric filter as claimed in claim 1, wherein said non-conductive region of short-circuiting conductor formed on said short-circuit end surface comprises a pair of shallow slits which extend along oppositely disposed respective longer edges of said rectangular short-circuit end surface.

6. A dielectric filter as claimed in claim 5, wherein said slits are formed by screen printing or patterning at the time of forming of the external and short-circuiting conductors on said dielectric block.

7. A dielectric filter according to claim 1, wherein said non-conductive region of short-circuiting conductor formed on said short-circuit end surface has said longitudinal width smaller than a longitudinal width of the block.

8. A dielectric filter as claimed in claim 1, wherein said longitudinal width of said non-conductive region is set to a value of 1.51 to less than 2.31 times as large as said longitudinal distance between the through holes of the outermost resonators.

* * * * *